US010883760B2

(12) United States Patent
Mosebrook et al.

(10) Patent No.: US 10,883,760 B2
(45) Date of Patent: Jan. 5, 2021

(54) BEVERAGE CHILLING CANISTER

(71) Applicants: Cynthia Mosebrook, Abbottstown, PA (US); Craig Mosebrook, Abbottstown, PA (US)

(72) Inventors: Cynthia Mosebrook, Abbottstown, PA (US); Craig Mosebrook, Abbottstown, PA (US)

( * ) Notice: Subject to any disclaimer, the term of this patent is extended or adjusted under 35 U.S.C. 154(b) by 169 days.

(21) Appl. No.: 15/834,513

(22) Filed: Dec. 7, 2017

(65) Prior Publication Data

US 2018/0306494 A1 Oct. 25, 2018

Related U.S. Application Data

(60) Provisional application No. 62/602,409, filed on Apr. 24, 2017.

(51) Int. Cl.

| | |
|---|---|
| ***A47G 23/04*** | (2006.01) |
| ***F25D 31/00*** | (2006.01) |
| ***F25D 3/06*** | (2006.01) |
| ***A47G 23/02*** | (2006.01) |
| ***F25D 3/08*** | (2006.01) |

(52) U.S. Cl.

CPC ..... *F25D 31/007* (2013.01); *A47G 23/0241* (2013.01); *A47G 23/04* (2013.01); *F25D 3/06* (2013.01); *F25D 3/08* (2013.01); *F25D 2303/081* (2013.01); *F25D 2331/803* (2013.01); *F25D 2331/809* (2013.01)

(58) Field of Classification Search

CPC ..... F25D 2331/803; F25D 2331/809; F25D 31/007; A47G 23/0241; A47G 23/04

See application file for complete search history.

(56) References Cited

U.S. PATENT DOCUMENTS

| | | | | |
|---|---|---|---|---|
| 3,998,072 | A | 12/1976 | Shaw | |
| 4,338,795 | A | 7/1982 | House, Jr. | |
| 4,823,974 | A | 4/1989 | Crosser | |
| 5,904,267 | A | 5/1999 | Thompson | |
| 6,155,452 | A * | 12/2000 | Laurent | B65D 81/3876 220/711 |
| 7,118,005 | B2 * | 10/2006 | Shimazaki | F25D 3/08 220/737 |
| 9,988,202 | B2 * | 6/2018 | Haas | A47G 23/0241 |
| 2016/0273829 | A1 * | 9/2016 | Cheng | F25D 3/08 |
| 2017/0137207 | A1 * | 5/2017 | Mackintosh | B65D 81/3881 |

FOREIGN PATENT DOCUMENTS

| | | | | |
|---|---|---|---|---|
| FR | 2550932 | A1 * | 3/1985 | A47G 23/0241 |

* cited by examiner

*Primary Examiner* — Filip Zec
(74) *Attorney, Agent, or Firm* — Barley Snyder

(57) ABSTRACT

A beverage chilling canister with the beverage container that is being chilled in the canister remaining in the canister when the beverage is poured from the beverage container, thereby avoiding ice displacement when the beverage container is otherwise removed from the canister to pour the beverage and moisture on the outside surface of the beverage container from dripping when the beverage container is otherwise removed from the canister to pour the beverage.

9 Claims, 7 Drawing Sheets

BEVERAGE CHILLING CANISTER

CROSS-REFERENCE TO RELATED APPLICATIONS

This application claims the benefit of the filing date of Provisional Patent Application No. 62/602,409, filed Apr. 24, 2017.

FIELD OF THE INVENTION

The invention relates, in general, to chilling beverages and, in particular, to canisters in which beverage containers, such as wine bottles, are chilled.

BACKGROUND

When chilling a beverage container in a canister of ice, it becomes difficult to return the beverage container into the canister after the beverage container has been removed from the canister, for example, to pour the beverage because the ice in the canister is displaced filling the void that is developed when the beverage container is removed from the canister. Typically, the returned beverage container sits on top of the ice, rather than being surrounded by the ice. This results in the beverage not being maintained at the desired temperature. In addition, moisture on the outside surface of the beverage container tends to drip when the beverage is being poured.

SUMMARY

A beverage chilling canister, constructed in accordance with the invention includes a tubular body closed at a first end and open at a second end and a lid secured to the tubular body at the open second end of the tubular body. The lid has a top wall with an opening centered on the longitudinal axis of the tubular body and sized to permit passage of the neck of a beverage container in the tubular body. The lid also has a side wall in contact with the outer surface of the tubular body at the open second end of the tubular body and extending parallel to the longitudinal axis of the tubular body toward the closed first end of the tubular body. The lid further has a neck receiving passageway extending along the longitudinal axis of the tubular body to the opening in the top wall of the lid and sized to permit passage of the neck of a beverage container in the tubular body.

DETAILED DESCRIPTION OF THE EMBODIMENT(S)

Figure 1:
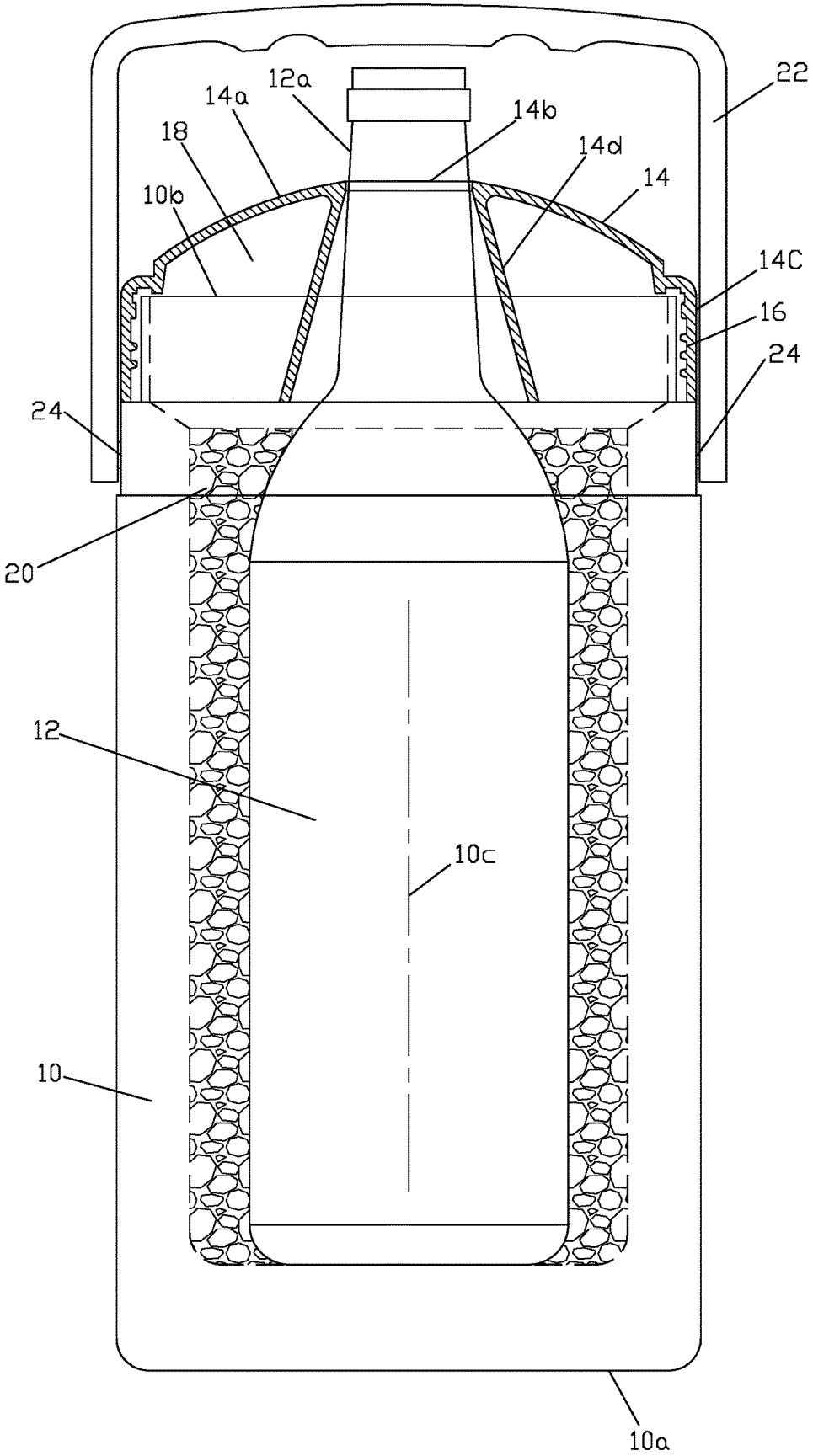
FIG. 1 is a sectional front view of a beverage chilling canister constructed in accordance with the invention with a beverage container in the beverage chilling canister.
Figure 2:
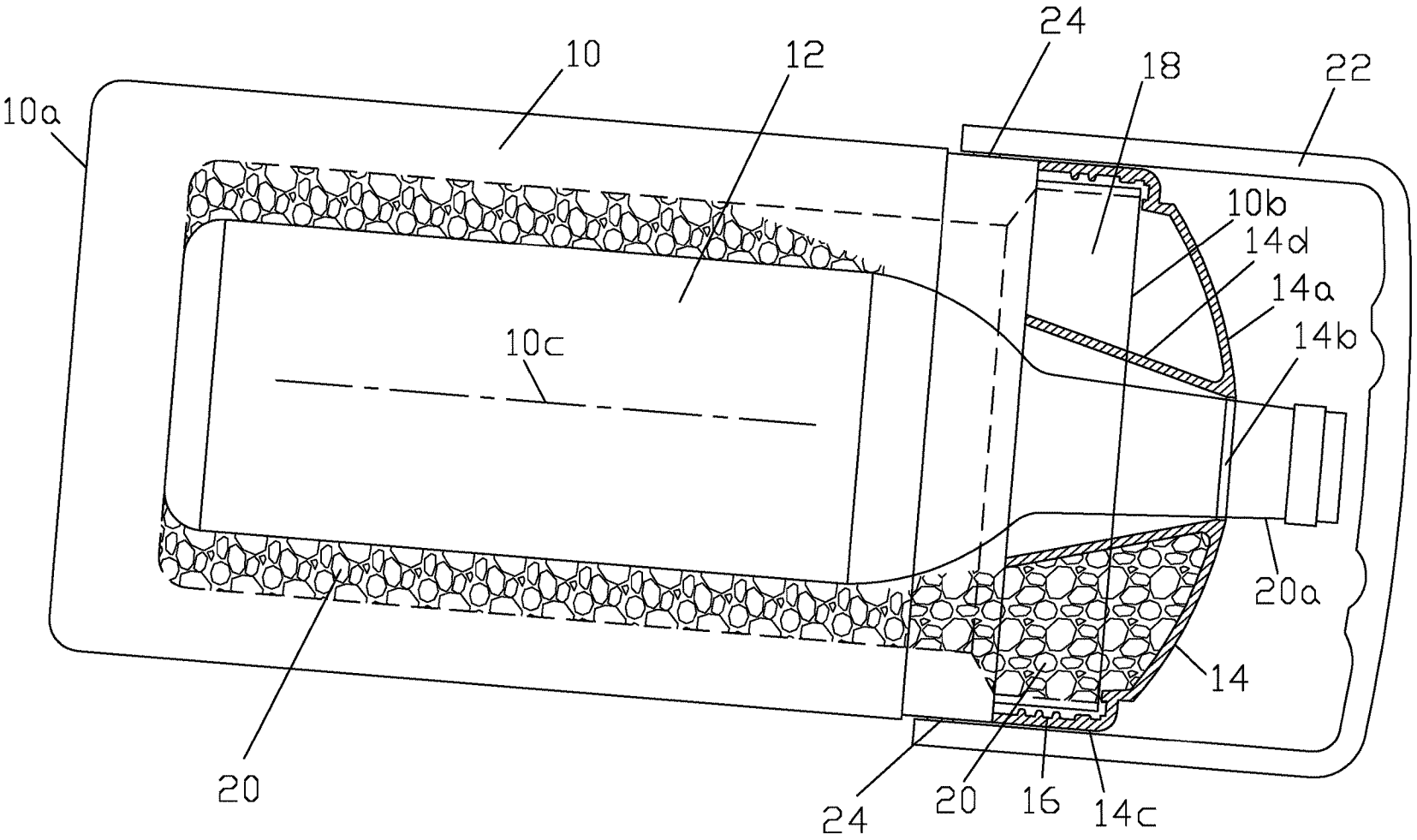
FIG. 2 shows the FIG. 1 beverage chilling canister positioned to pour the contents of the beverage container.
Figure 3:
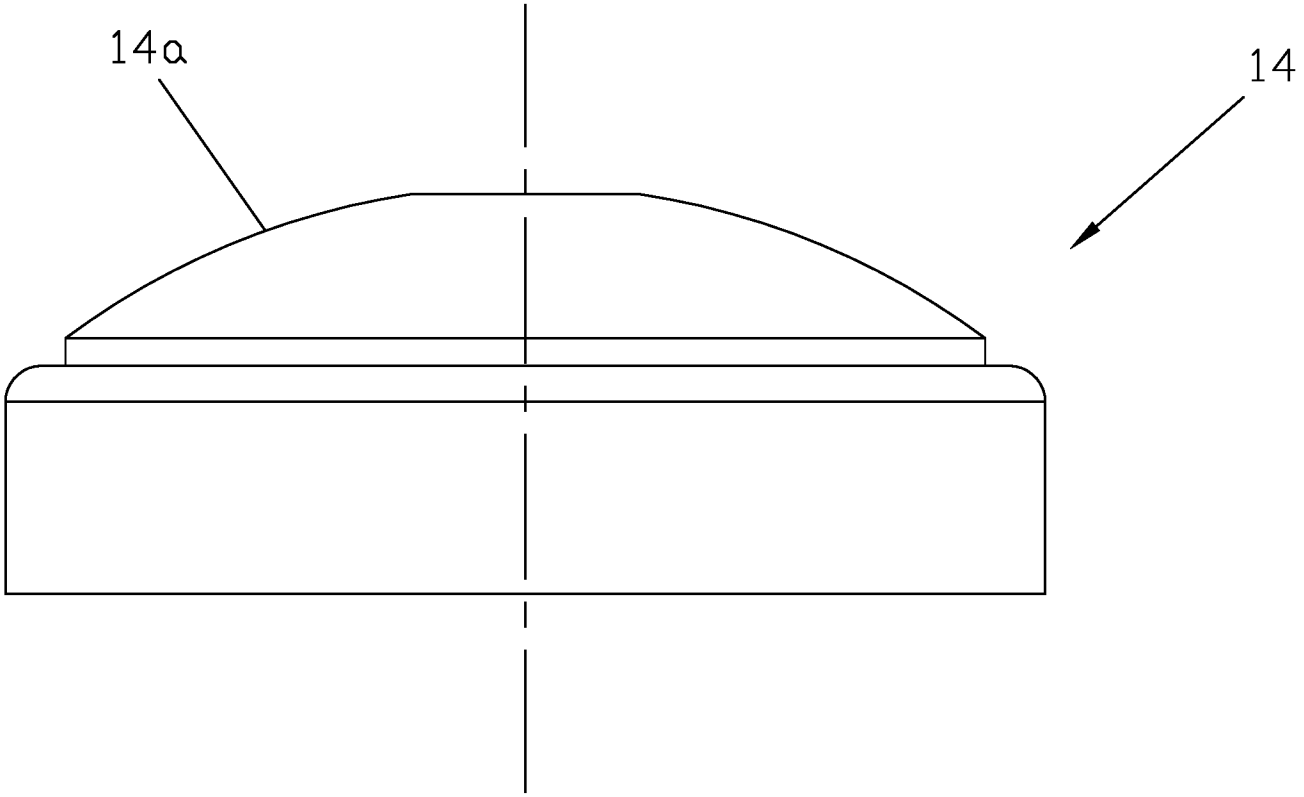
FIG. 3 is a side view of the lid of the FIG. 1 beverage chilling canister.
Figure 4:
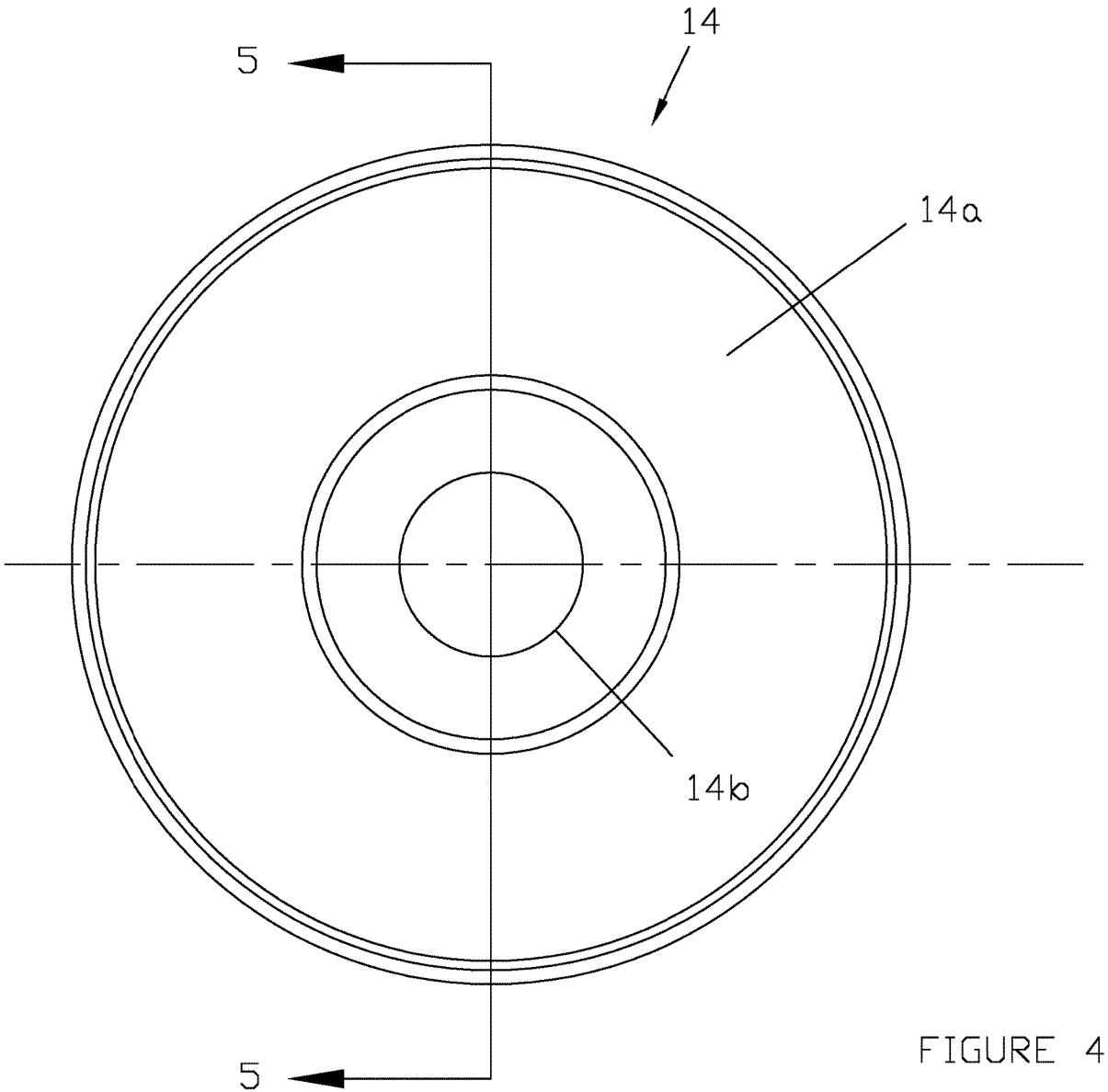
FIG. 4 is a top view of the lid of the FIG. 1 beverage chilling canister.
Figure 5:
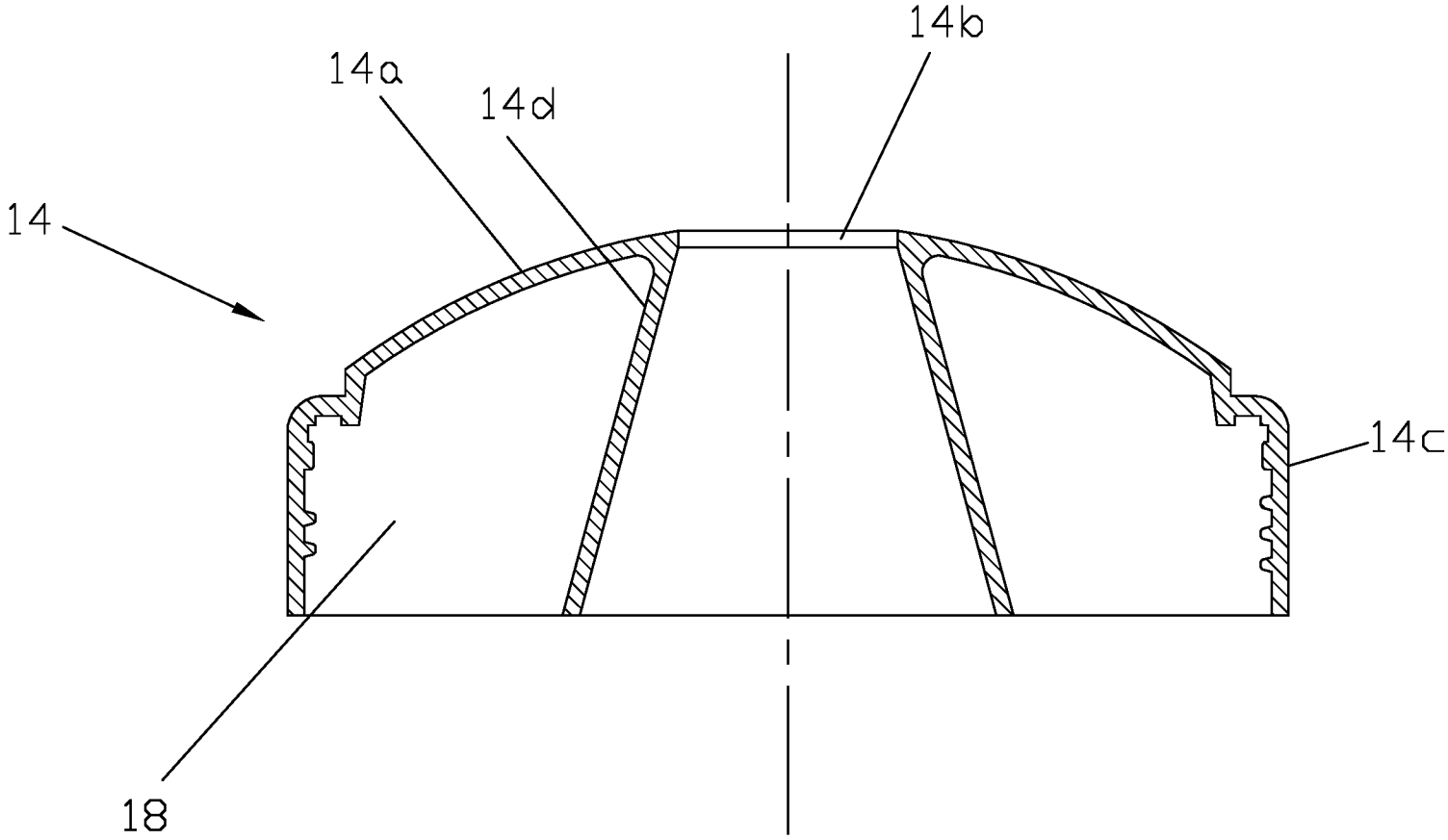
FIG. 5 is a sectional view of the lid of the FIG. 1 beverage chilling canister taken along line 5-5 of FIG. 4.

Referring to FIGS. 1 and 2, a beverage chilling canister, constructed in accordance with the invention, includes a tubular body 10 that has a closed first end 10*a* and an open second end 10*b*. For the embodiment of the invention illustrated and being described, the tubular body 10 is cylindrical and extends along a longitudinal axis 10*c* that is shown in dot-dash lines. A beverage container 12 is positionable in the tubular body 10.

Referring to FIGS. 1 through 5, a beverage chilling canister, constructed in accordance with the invention, also includes a the lid 14 secured to the tubular body 10 at the open second end 10*b* of the tubular body 10. The lid 14 includes a top wall 14*a* having an opening 14*b* centered on the longitudinal axis 10*c* of the tubular body 10. The opening 14*b* is sized to permit passage of a neck 12*a* of beverage container 12. For the embodiment of the invention illustrated and being described, the top wall 14*a* is dome shaped.

The lid 14 has a side wall 14*c* in contact with an outer surface of the tubular body 10 at the open second end 10*b* of the tubular body 10. The side wall 14*c* of the lid 14 extends parallel to the longitudinal axis 10*c* of the tubular body 10 toward the closed first end 10*a* of the tubular body 10. The lid 14 includes a neck receiving passageway 14*d* that extends along the longitudinal axis 10*c* of tubular body 10. The neck receiving passageway 14*d* of the lid 14 is sized to permit passage of the neck 12*a* of beverage container 12 in the tubular body. For the embodiment of the invention illustrated and being described, neck receiving passageway 14*d* in the lid 14 is tapered with the diameter of the end of the neck receiving passageway 14*d* at the top wall 14*a* of the lid smaller than the diameter of the neck receiving passageway 14*d* at the opposite end of the neck receiving passageway. A chamber 18 is formed between neck receiving passageway 14*d* of the lid 14 and top wall 14*a* of the lid 14 and the side wall 14*c* of the lid 14.

The lid 14 is secured to tubular body 10 by a fastening mechanism, such as a screw thread connection 16 in the shown embodiment. However, other conventional fastening means can be used to secure the lid 14 to tubular body 10.

A beverage chilling canister, constructed in accordance with the invention, is put to use in the following manner.

With the beverage chilling canister in the FIG. 1 loading position, beverage container 12 is placed in the beverage chilling canister and ice 20 then is deposited in the space between the beverage container and the inside surface of tubular body 10.

When the contents of beverage container 12 are to be poured out, the beverage chilling canister is moved by the pourer into the pouring position as shown in FIG. 2. With beverage container 12 still in the beverage chilling canister, the contents of the beverage container can be poured out. Ice 20 that might have melted and moisture that might have developed on the outside surface of the beverage container are captured in chamber 18 of the lid 14 or remain is the space between tubular body 10 and the beverage container 12.

This construction of the beverage chilling canister permits pouring out the beverage without removing beverage container 12 from the canister, thereby eliminating, at least greatly mitigating, displacement of the ice in the canister and melted ice and moisture on the surface of the beverage container from escaping when the beverage is being poured out.

The outside diameter of the beverage chilling canister depends on the diameter of beverage container 12, the thickness of tubular body 10, and the space between the beverage container and the inside surface of the tubular body into which ice 20 is deposited. A typical wine bottle has a 2.94" diameter. If the inside diameter of tubular body 10 is, for example, 4.13", the space between a wine bottle having a 2.94" diameter and the inside surface of the tubular body into which ice 20 is deposited is 0.59". With a tubular body 10 thickness of, for example, about 0.7", the outside diameter of the beverage chilling canister is about 5.5".

A beverage chilling canister, constructed in accordance with the invention, can be used with a variety of beverage containers. Among the related design parameters for a beverage chilling canister constructed in accordance with the invention are:

Outside diameter small enough so the canister can be handled with one hand by a person having large hands or with two hands by a person having small hands;

Adequate ice space between the outside of the beverage container and the inside of the tubular body to provide the proper chilling effect; and Choice of material of the tubular body so that the chilling effect is minimally conducted through the tubular body.

Figure 6:
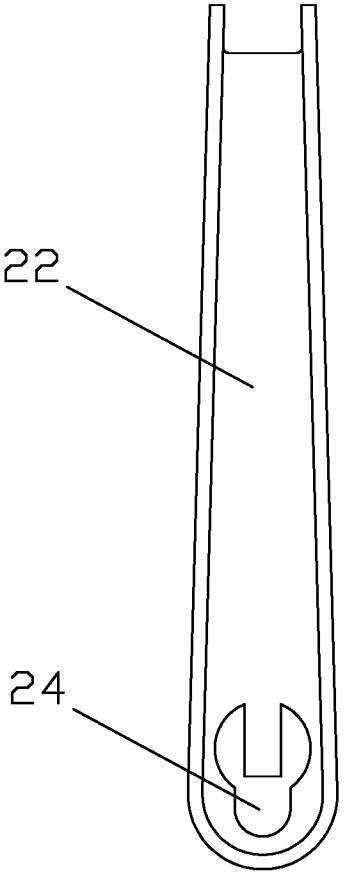
FIG. 6 is a side view of the handle of the FIG. 1 beverage chilling canister.

One structural alternative that effectively addresses these related design parameters is to provide some form of means for handling the beverage chilling canister while pouring the contents of the beverage container. As shown in FIG. 6, a beverage chilling canister, constructed in accordance with the invention, can include a handle 22, secured to tubular body 10 by suitable means such as rivets or fasteners 24, and preferably formed from a non-heat conducting material, such as plastic. The inclusion of handle 22 reduces concerns about the outside diameter of the beverage chilling canister and the chilling effect being conducted through the tubular body.

Figure 7:
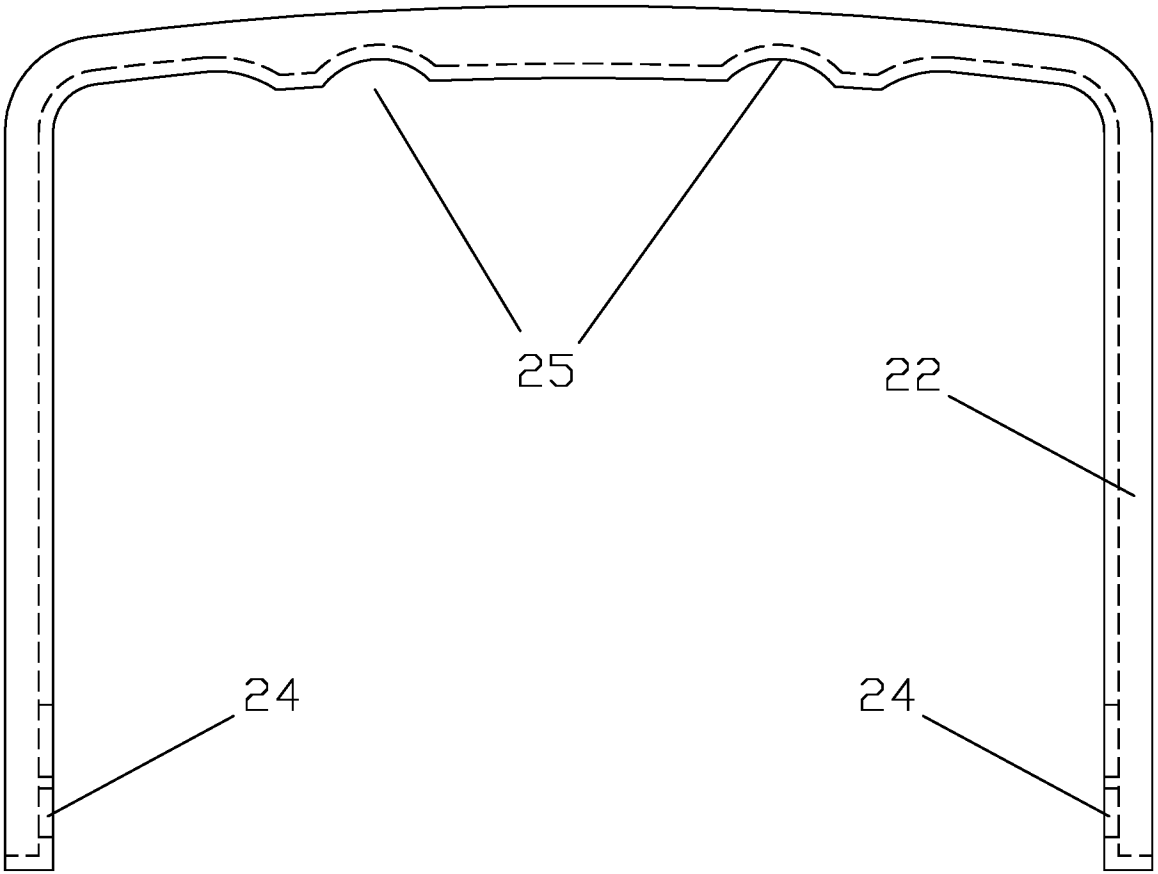
FIG. 7 is a front view of the handle of the FIG. 1 beverage chilling canister.

As shown in FIG. 7, tubular body 10, of a beverage chilling canister constructed in accordance with the invention, can be formed with a gripping recess 25. The inclusion of gripping recess 25 also reduces the concerns about the outside diameter of the beverage chilling canister.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A beverage chilling canister comprising:

a tubular body having:

(a) a closed first end, (b) an open second end, and (c) a beverage container receiving space between the closed first end and the open second end and having a cross-section large enough to receive:

(1) a beverage container, and (2) ice between an inner wall of the tubular body and an outside surface of the beverage container; and a lid secured to the tubular body at the open second end of the tubular body and having:

(a) a top wall with an opening centered along a longitudinal axis of the tubular body, (b) a side wall in contact with an outer surface of the tubular body at the open second end of the tubular body and extending parallel to the longitudinal axis of the tubular body toward the closed first end of the tubular body, and (c) a tapered neck receiving passageway:

(1) extending along the longitudinal axis of the tubular body to the opening in the top wall of the lid, (2) having a diameter of the end of the neck receiving passageway at the top surface of the lid smaller than the diameter of the neck receiving passageway at the opposite end of the neck receiving passageway, (3) sized to permit passage of a neck of a beverage container in the tubular body, and (4) defining, with the top wall of the lid and the tubular body at the open second end of tubular body, a chamber at the open second end of the tubular body that is in open communication with a space between the inner wall of the tubular body and the outside surface of the beverage container.

2. The beverage chilling canister according to claim 1, wherein the tubular body is cylindrical.

3. The beverage chilling canister according to claim 2, wherein the top wall of the lid is dome shaped.

4. The beverage chilling canister according to claim 3, wherein the lid is secured to the tubular body by a screw thread connection.

5. The beverage chilling canister according to claim 1, further comprising a handle secured to the tubular body.

6. The beverage chilling canister according to claim 2, further comprising a handle secured to the tubular body.

7. The beverage chilling canister according to claim 1, wherein the tubular body has a gripping recess.

8. The beverage chilling canister according to claim 2, wherein the tubular body has a gripping recess.

9. A beverage chilling canister comprising:

a tubular body having:

(a) a closed first end, (b) an open second end, and (c) a beverage container receiving space between the closed first end and the open second end and having a cross-section large enough to receive:

(1) a beverage container, and (2) ice between an inner wall of the tubular body and an outside surface of a beverage container; and a lid secured to the tubular body at the open second end of the tubular body and having:

(a) a top wall with an opening centered along a longitudinal axis of the tubular body, (b) a side wall in contact with an outer surface of the tubular body at the open second end of the tubular body and extending parallel to the longitudinal axis of the tubular body toward the closed first end of the tubular body, and (c) a tapered neck receiving passageway:

(1) extending along the longitudinal axis of the tubular body to the opening in the top wall of the lid, (2) having a diameter of the end of the neck receiving passageway at the top surface of the lid smaller than the diameter of the neck receiving passageway at the opposite end of the neck receiving passageway, (3) sized to:

(i) permit passage of a neck of a beverage container in the tubular body, and (ii) prevent passage of the body of a beverage container, and (4) defining with the top wall of the lid and the tubular body at the open second end of the tubular body a chamber at the open second end of the tubular body that is in open communication with a space between the inner wall of the tubular body and the outside surface of the beverage container.

* * * * *